US008851085B2

(12) United States Patent
Fracassi et al.

(10) Patent No.: US 8,851,085 B2
(45) **Date of Patent: *Oct. 7, 2014**

(54) PAIRED ARTIFICIAL NAILS

(71) Applicant: Pacific World Corporation, Aliso Viejo, CA (US)

(72) Inventors: Joseph Michael Fracassi, Lake Forest, CA (US); Jeanine Catherine Coppola, Irvine, CA (US)

(73) Assignee: Pacific World Corporation, Aliso Viejo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/060,179

(22) Filed: Oct. 22, 2013

(65) Prior Publication Data

US 2014/0048087 A1 Feb. 20, 2014

Related U.S. Application Data

(63) Continuation of application No. 13/416,704, filed on Mar. 9, 2012, now Pat. No. 8,596,283, which is a continuation of application No. 11/745,236, filed on May 7, 2007, now Pat. No. 8,132,568.

(51) Int. Cl.

| | |
|---|---|
| ***A45D 29/00*** | (2006.01) |
| ***A45D 31/00*** | (2006.01) |
| ***A45C 11/00*** | (2006.01) |

(52) U.S. Cl.

CPC ..... *A45D 31/00* (2013.01); *A45C 11/00* (2013.01)

USPC ..... 132/73

(58) Field of Classification Search

CPC ..... A45D 31/00; A45D 2031/00

USPC ..... 132/73, 73.5, 76.5; D28/56, 57, 61

See application file for complete search history.

(56) References Cited

U.S. PATENT DOCUMENTS

| | | | |
|---|---|---|---|
| 2,239,040 | A | 4/1941 | Holmes |
| D136,030 | S | 7/1943 | Belmonte et al. |
| 2,417,677 | A | 3/1947 | Cohan |
| 2,941,535 | A | 6/1960 | Lappe |

(Continued)

FOREIGN PATENT DOCUMENTS

| | | | |
|---|---|---|---|
| EP | 1902645 | A2 | 3/2008 |
| EP | 1920675 | A1 | 5/2008 |

(Continued)

*Primary Examiner* — Rachel Steitz

(74) *Attorney, Agent, or Firm* — Eric B. Fugett; Waller Lansden Dortch & Davis, LLP

(57) ABSTRACT

A preformed artificial nail assembly comprising a pair of artificial nails sized to correspond to at least a portion of said natural nail, and an application tab assembly extending between the pair of artificial nails. The application tab assembly includes a body portion and a neck portion adjacent each said artificial nail, said neck portion being disposed between the body portion and the lower surface of the free edge of the artificial nail. The application tab assembly may include an area of weakness that allows the assembly to be separated into two separate tabs, one adjacent each of the artificial nails of the pair. The user may utilize the application tab assembly as a single unit to place the nails, or separate the assembly into two separate tabs to allow the user to place the nails utilizing separate tabs.

21 Claims, 5 Drawing Sheets

(56) References Cited

U.S. PATENT DOCUMENTS

| | | | |
|---|---|---|---|
| 3,157,912 | A | 11/1964 | Lisczawka |
| 3,552,401 | A | 1/1971 | Michaelson |
| 3,578,158 | A | 5/1971 | Aylott |
| 3,722,104 | A | 3/1973 | Enzetti |
| 3,982,551 | A | 9/1976 | Bartolucci |
| 3,993,084 | A | 11/1976 | Cullen |
| 4,007,748 | A | 2/1977 | Matranga et al. |
| 4,106,614 | A | 8/1978 | Aylott |
| 4,346,720 | A | 8/1982 | Hokama |
| 4,554,935 | A | 11/1985 | Hokama |
| 4,718,957 | A | 1/1988 | Sensenbrenner |
| 4,751,935 | A | 6/1988 | Mast et al. |
| 4,805,645 | A | 2/1989 | Schiff et al. |
| D309,196 | S | 7/1990 | LaJoie |
| 5,005,595 | A | 4/1991 | Aylott |
| 5,060,678 | A | 10/1991 | Bauman et al. |
| 5,450,864 | A | 9/1995 | LaJoie et al. |
| D376,224 | S | 12/1996 | Fojon |
| D386,823 | S | 11/1997 | Carroll et al. |
| 5,816,408 | A | 10/1998 | Indelicato |
| 5,832,936 | A | 11/1998 | Pruchnic et al. |
| 5,860,429 | A | 1/1999 | Chang |
| 5,901,714 | A | 5/1999 | Benkart |
| 5,944,027 | A | 8/1999 | Chang |
| D433,536 | S | 11/2000 | Schwartz |
| 6,196,234 | B1 | 3/2001 | Gifford |
| D441,134 | S | 4/2001 | Manzione |
| 6,220,250 | B1 | 4/2001 | Park |
| 6,328,039 | B1 | 12/2001 | Chang |
| 6,354,304 | B1 | 3/2002 | Chang |
| D455,866 | S | 4/2002 | Baltierra |
| 6,892,736 | B2 | 5/2005 | Chang et al. |
| 7,100,619 | B2 | 9/2006 | Kim |
| 7,150,281 | B2 | 12/2006 | Han |
| 7,185,660 | B1 | 3/2007 | Han |
| 7,337,783 | B2 | 3/2008 | Han |
| 2002/0023656 | A1 | 2/2002 | Chang |
| 2003/0178040 | A1 | 9/2003 | Swensen |
| 2004/0079381 | A1 | 4/2004 | Han |
| 2004/0173232 | A1 | 9/2004 | Chang et al. |
| 2004/0216757 | A1 | 11/2004 | Chang |
| 2005/0121048 | A1 | 6/2005 | Han |
| 2005/0183735 | A1 | 8/2005 | Robinson |
| 2006/0191551 | A1 | 8/2006 | Han |
| 2006/0237027 | A1 | 10/2006 | Han |
| 2007/0277841 | A1* | 12/2007 | Kim ..... 132/73 |
| 2008/0017211 | A1 | 1/2008 | Han |
| 2008/0017212 | A1 | 1/2008 | Han |
| 2008/0017213 | A1 | 1/2008 | Han |
| 2008/0017214 | A1 | 1/2008 | Han |
| 2008/0099037 | A1 | 5/2008 | Chang |

FOREIGN PATENT DOCUMENTS

| | | | |
|---|---|---|---|
| FR | 2534120 | | 4/1984 |
| GB | 752960 | | 5/1954 |
| GB | 725969 | | 3/1955 |
| JP | 2002-034641 | A | 2/2002 |
| JP | 2004-081843 | A | 3/2004 |
| JP | 2006-181349 | A | 7/2006 |
| KR | 20-0327518 | Y1 | 9/2003 |
| KR | 2004059956 | A | 7/2004 |
| KR | 605671 | B1 | 8/2006 |
| KR | 10-0765334 | A | 9/2006 |
| KR | 2008-0037352 | A | 10/2006 |
| KR | 10-0659692 | A | 12/2006 |
| KR | 737424 | B1 | 7/2007 |
| KR | 765332 | B1 | 10/2007 |
| WO | WO-2006/062963 | A1 | 6/2006 |

* cited by examiner

PAIRED ARTIFICIAL NAILS

RELATED APPLICATIONS

This application is a continuation of U.S. application Ser. No. 13/416,704, filed Mar. 9, 2012, which itself is a continuation of U.S. application Ser. No. 11/745,236, filed May 7, 2007, which issued on Mar. 3, 2012 as U.S. Pat. No. 8,132,568.

FIELD OF THE INVENTION

The present invention relates to human nail decorations, and more specifically the invention pertains to structure and methods for placement of preformed artificial nails and tips for adherence to human nails.

BACKGROUND OF THE INVENTION

For various aesthetic reasons, many individuals wish to possess elongated fingernails or fingernails having a more finished or polished appearance. However, some are unable or unwilling to grow their own natural fingernails out to the desired length. Alternately, they may not have the time, skill, or financial wherewithal to maintain or obtain a more finished appearance that may result from well manicured and/or polished nails. As a result, entire industries have developed around the artificial supplementation and enhancement of natural nails. Such enhancements may range from manicuring and polishing of natural fingernails to individually building artificial nails on the natural nail and nail form from an acrylic powder and liquid which chemically bond to the nail surface as the artificial nail is built. Between these two extremes, are preformed, artificial nails that are glued or otherwise bonded to a person's own naturally occurring fingernails. Such nails are readily available to a wide range of users through drug stores, food stores, dollar store and department stores. Such preformed artificial nails may be clear or opaque, and/or prepolished and/or decorated to provide the desired appearance.

Artificial nails are commonly made from molded thermoplastic and are available in a wide range of lengths and styles. One broad category of an artificial nail style is the full nail form. As its name implies, the full nail form simulates the entire human fingernail and includes a proximate edge intended to overlay substantially the entire nail bed and a distal free edge which is intended to extend beyond the fingertip of the wearer. The proximate edge is shaped to be disposed substantially adjacent or abut against the cuticle of the finger. The distal free edge may have any of various lengths and shapes, such as oval, square, or flared, depending upon the desired look. Preferably, the artificial nail is sufficiently durable and rigid to withstand the hazards inherent in its use.

In contrast, nail tips do not simulate the complete nail, but, rather, only the free edge and, typically, a small extended portion to cover only a portion of the nail bed in order to facilitate attachment to the nail. In use, nail tips are secured to the edge of the nail bed adjacent the free edge and the tip only. Tips are often utilized with the construction of acrylic nails or gel nails.

Manufacturers typically provide users with a range of nail sizes, e.g., identified by size numbers 0-9, to accommodate most nail sizes. Generally, artificial nails are packaged together in sets including a range of different sizes so that the purchaser receives differently artificial nails for their different fingers. In addition to the set of different sized artificial nails, the package may also include liquid adhesive, peel-off adhesive pads, and/or preplaced tacky adhesive for bonding the artificial nails to the purchaser's natural fingernails.

Artificial nails are provided in a variety of lengths ranging from relatively long nails having either a straight profile or arched profile, to relatively short nails, which more closely simulate well groomed natural nails. In placement of the artificial nail on a user's natural nail, the adhesive is typically applied either directly to the user's natural nail bed or to the nail bed portion of the artificial nail. The artificial nail is then placed on the user's natural nail bed with the proximal end of the artificial nail disposed at or near the user's cuticle, and pressure is applied to ensure the desired adhesion of the artificial nail to the user's natural nail. Inasmuch as the adhesive used in placing artificial nails is generally tacky, it is difficult to make adjustments to the position of the artificial nail on the natural nail once initial placement is made. Attempts to reposition the artificial nail relative to the natural nail or to remove and replace the artificial nail may result in either a substandard appearance to the artificial nail, or time consuming additional cleaning of the artificial nail and repetition of the placement process. As a result, it is important that the artificial nail be placed at the desired position on the natural nail at the first attempt so as to avoid the need to remove and reposition the nail.

Longer artificial nails typically extend well beyond the free edge of the user's natural nails. Consequently, in placing relatively long artificial nails on the user's natural nails, one may generally utilize the extended free edge of the artificial nail to hold the artificial nail prior to placement, and to manipulate and accurately position the artificial nail on the user's nail bed. When utilizing smaller artificial nails, however, the free edge is very short, and does not extend far beyond the user's natural nail or finger tip, if at all. Accordingly, such short nails can be particularly difficult to accurately place on the user's natural nail by simply grasping the artificial nail using one's fingers.

As a result, manufacturers have proposed various tools to allow for holding and placing artificial nails during application. One such tool comprises an elongated rod with a tacky adhesive pad or tape at the end of the tool to grip the artificial nail, such as the tools shown in U.S. Pat. No. 6,220,250 to Park and the tool marketed by Sally Hansen®. This tacky, adhesive pad, however, has proven unreliable in use, however, inasmuch as the retaining force exerted by the adhesive on the artificial nail typically deteriorates over time such that it does not exert a consistent retaining force on the artificial nail. Moreover, should the adhesive pad become contaminated with dust or the like, it becomes generally useless in that it does not exhibit adequate force to retain a series of nails for placement.

Another such tool is shaped like a concave shovel with a shorter opposing lip that is disposed parallel to the shovel such that a small slot or gap is formed between the inside surface of the shovel and the lip, as shown in U.S. Patent D441,134 to Manzione and marketed by Uptown Nails, LLC. In use, the outer, arched surface of the artificial nail is disposed against the inside surface of the shovel with the free edge of the artificial nail disposed in the gap between the lip and the shovel. This tool likewise exhibits deficiencies. While the "shovel" tool does not deteriorate with use, it is cumbersome to utilize. Should the gap between the shovel and lip be sufficiently small to exert a retaining force on the artificial nail, the user will typically be required to exert an external downward, retaining force on the artificial nail when it is placed against the natural nail in order to facilitate release of the artificial nail by the tool. Inasmuch as the user's free hand grasps the tool, the user must typically use a different finger from the placement hand to exert a retaining force the placed artificial nail to facilitate release of artificial nail from the tool. Conversely, if the tool does not exert adequate retaining force to hold the artificial nail during the placement process, the tool may allow artificial nail to move within the gap, making accurate placement of the artificial nail against the natural nail significantly more difficult.

The assignee of the present invention has proposed a tool that utilizes a small suction cup disposed at the distal end of an elongated rod. In applying an artificial nail to a natural nail, the user places the suction cup on the upper surface of the artificial nail and expels any air trapped between the cup and the nail. The user then utilizes the tool to position the artificial nail on the natural nail. The suction cup provides sufficient force to retain the nail during placement, yet that force is overcome by the tackiness of the adhesive or the adhesive bond between the artificial nail and the natural nail once properly placed. Moreover, the retaining force of the tool typically does not deteriorate over time. The tool is disclosed in greater detail in PCT Publication WO06/062963A.

Manufacturers have likewise proposed severable protrusions that extend from one or more edges of the artificial nail itself. The protrusions are utilized to place the artificial nail and then severed from the nail once proper placement has been achieved. For example, U.S. Pat. No. 6,892,736 to Chinn et al. includes a tab that extends from the distal edge of the nail. A similar arrangement is disclosed in U.S. Pat. No. 5,005,595 to Aylott.

While nail packaging often times includes single nails displayed in individual display wells or product bubbles, in view of space considerations, artificial nail packaging generally includes a larger well or space that includes a plurality of nails in loose or free configuration. This is generally the case with both artificial nails without application tabs, and artificial nails that include application tabs. Such is the case with nails incorporating aspects of the design disclosed in the '736 patent to Chinn. Nails marketed under the name Broadway Nails—Real Life French Nail Kit include a tab and nail arrangement shaped generally as shown in the '736 patent. The packaging of the Real Life French Nail Kit includes a general well which encloses a plurality of nails together in a loose configuration.

While nails are sometimes identified by a size number, unfortunately, this loose configuration can make it difficult to locate an artificial nail in a desired size for placement on a nail. This problem can be aggravated in packages where the nails include an application tab, which can cause nails to become further entangled. Possible solutions to this dilemma include the provision of a product bubble for each nail, respectively, or the provision of all such nails of a package attached to a nail tree. Examples of such nail trees are provided in the '736 patent to Chinn, as well as a number of other references. Unfortunately, both of these solutions typically require the use of a larger packaging arrangement than may be utilized when a large product well is used to contain a plurality of loose nails. Such larger packages may be undesirable when display space at a retail establishment is limited or at a premium.

As a result, it is desirable to provide a nail placement arrangement that overcomes these shortcomings of the prior art to provide for accurate and reliable, repeatable placement of artificial nails. It is further desirable that the arrangement for presentation of such nails in a package is easy to utilize and facilitates location of desired nail sizes, yet does not require presentation of each nail individually or on a single tree.

BRIEF SUMMARY OF THE INVENTION

The invention provides a nail application tab assembly that extends between a pair of artificial nails, preferably of the same size. The application tab assembly generally includes an area of weakness between the tab assembly and the respective nails to facilitate separation. The assembly also may optionally include an area of weakness within the tab assembly itself such that the tab assembly may be separated into two separate tabs, each secured to a respective artificial nail. In this way, the tab assembly may be kept as a single unit to facilitate placement of the nails, or the assembly may be separate tabs coupled to the respective nails. The weakened area within the tab assembly itself, and/or between the tab assembly and the artificial nails may include, for example, a perforation, an area of reduced thickness, a score line, or a reduced cross-sectional area.

The tab assembly may be secured to the artificial nails at any appropriate position. Preferably, it is disposed along the distal end of the nail, the body of the application tab assembly extending from the lower surfaces of the nails and/or the distal edges of the nails. Moreover, the tab assembly may be disposed in a relatively horizontal plane, a plane relatively vertical to one or more of the nails, or at any angle therebetween.

The kit may further include additional items such as an adhesive, a towelette including a cleaner, a roughening surface, a stick, and/or a placement tool.

These and other objects and advantages of the invention will be apparent to those skilled in the art upon reading the following summary and detailed description and upon reference to the drawings.

DETAILED DESCRIPTION OF THE INVENTION

Figure 1:
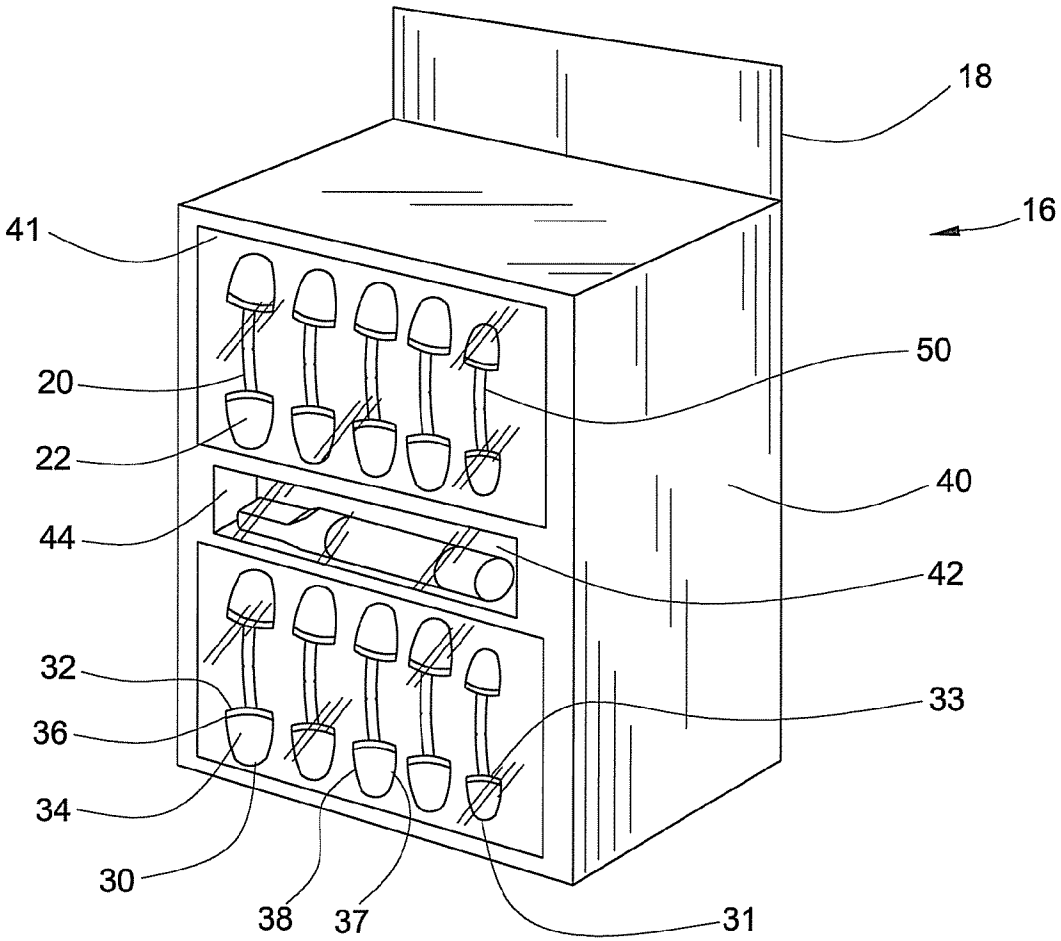
FIG. 1 is a perspective view of a kit having exemplary contents, including an artificial nail assembly according to teachings of the invention.

Turning now to the drawings, wherein like reference numbers refer to like elements, there is illustrated in FIG. 1 a nail kit 16 comprising a package 18 containing a plurality of preformed artificial nail assemblies 20. Each nail assembly 20 comprises an artificial nail 22 which has a proximal end 30, adapted to be placed generally adjacent the user's cuticle, and a distal end 32 that is generally disposed at or beyond the end of the user's natural nail when properly placed. The area between the proximal and distal ends 30, 32 of the artificial nail 22 generally defines the nail bed portion 34 and the free edge 36, the nail bed portion 34 being adapted to be placed adjacent the user's natural nail bed and the free edge 36 being adapted to extend beyond the end of the user's finger. The artificial nails 22 further include right and left side edges 37, 38 with the nail 22 having a generally arched contour between the side edges 37, 38 and a generally less arched contour between the proximal and distal edges 31, 33.

The nail kit package 18 typically includes an outer covering 40, here in the form of a box, having at least one transparent portion 41 for viewing the contents of the package 20. The package 20 further includes an inner support housing 42 that generally retains the contents of the package 20 in position within the package 20. The inner support housing is typically formed of a polymeric material. The inner support housing 42 generally includes a plurality of recessed areas 44, and additional contents of the package 20 may be retained in a rear open portion of the inner support housing 42.

Figure 2:
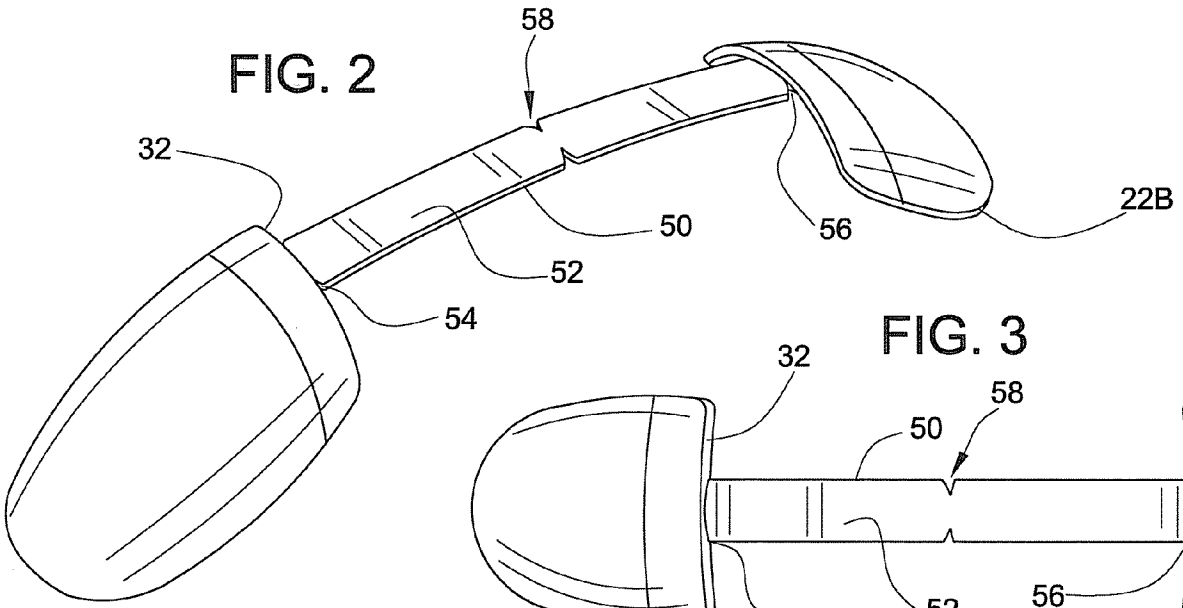
FIG. 2 is a perspective view of a pair of artificial nails with application tab constructed in accordance with teachings of the invention.
Figure 3:
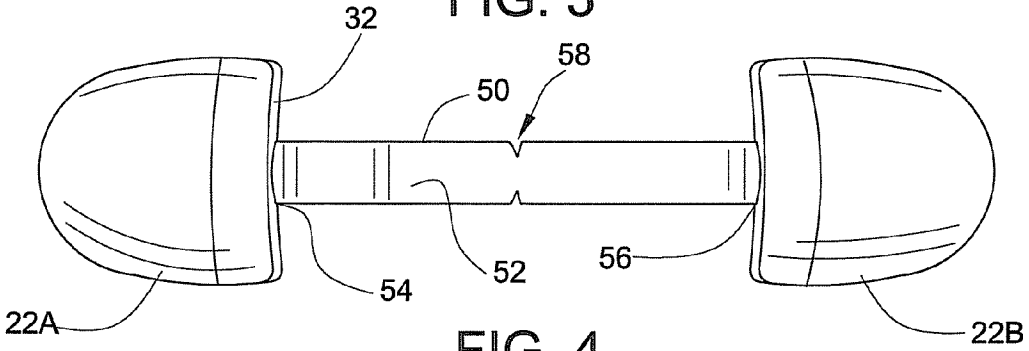
FIG. 3 is top plan view of the artificial nail assembly of FIG. 2.
Figure 4:
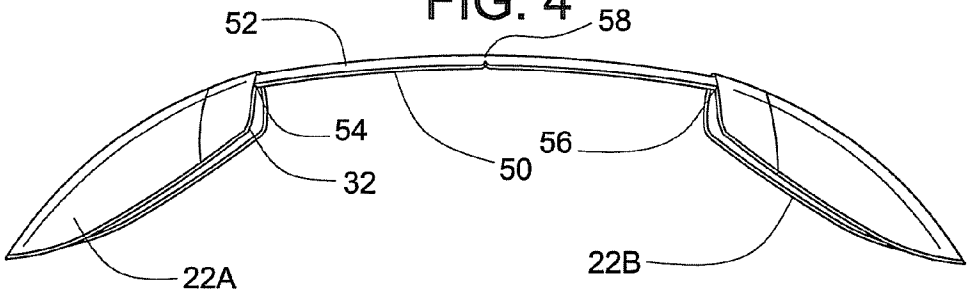
FIG. 4 is a side elevational view of the artificial nail assembly of FIGS. 2 and 3.

In accordance with the invention, the artificial nail assembly includes an application tab assembly 50 secured to a pair of artificial nails 22A, 22B, the application tab assembly 50 facilitates placement of an artificial nail 22A, 22B on a natural nail (see FIGS. 2-4). In order to assist the user in selection and placement of the nails, the artificial nails 22A, 22B of the pair are preferably of like size. The application tab assembly 50 includes a body 52 for the user to grasp during placement, and a neck 54, 56 that extends between the body 52 and the respective nails 22A, 22B.

Figure 9:
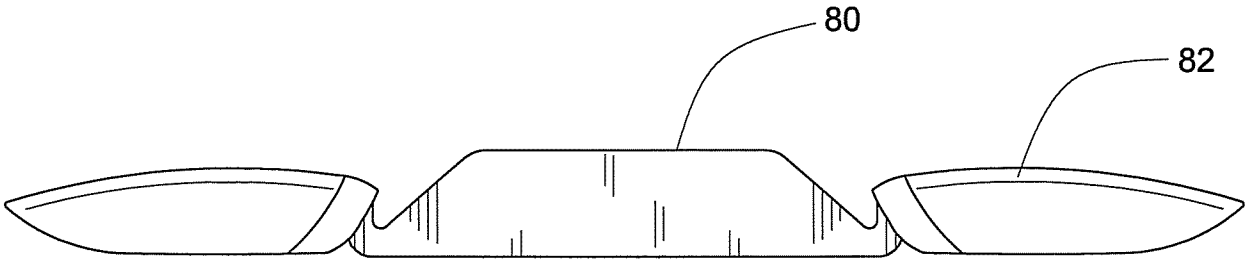
FIG. 9 is a perspective view of an alternate embodiment of a pair of artificial nails constructed in accordance with teachings of the invention.

The neck 54, 56 attaches the body 52 to the respective nails 22 at their distal ends 32. The nail tab arrangement may be of any suitable design, however. For example, while the neck 54 may extend from the distal edge 33, as shown in FIGS. 2-4, it may alternately extend from the upper or lower surface of the artificial nail 22 or a combination of the distal edge 33 and one or both of the upper or lower surfaces, as explained in greater detail in application Ser. No. 11/739,371, which is incorporated herein in its entirety for everything disclosed therein. As shown in that application, for example, the neck may extend from the lower surface. Such an arrangement is illustrated in FIG. 9. It will be appreciated by those of skill in the art that when the neck is separated from the nail in such an arrangement, the neck will not leave any sharp edges or points protruding from the distal edge of the nail, and subsequent manicuring, as by filing for example, may be minimized.

According to a feature of the invention, once appropriately placed, the application tab assembly 50 may be separated from the nail 22 by any appropriate mechanism. For example, the neck 54, 56 of the application tab assembly 50 may include a weakened area, such as, for example, a relatively small cross-section at the location where the neck 54, 56 meets the nail 22A, 22B, such as is as shown, for example in FIGS. 2-4, a thinned section substantially adjacent the nail 22, as shown, for example, at 64, 66 in FIGS. 5-7, a perforation, a score line, or any combination of such structures. Examples of such weakened areas are likewise shown in application Ser. No. 11/739,371. While less desirable, those of skill in the art will appreciate that the application tab assembly 50 could alternately be severed from the nail 22A, 22B by a tool, such as scissors or a blade.

Figures 5, 6, 7:
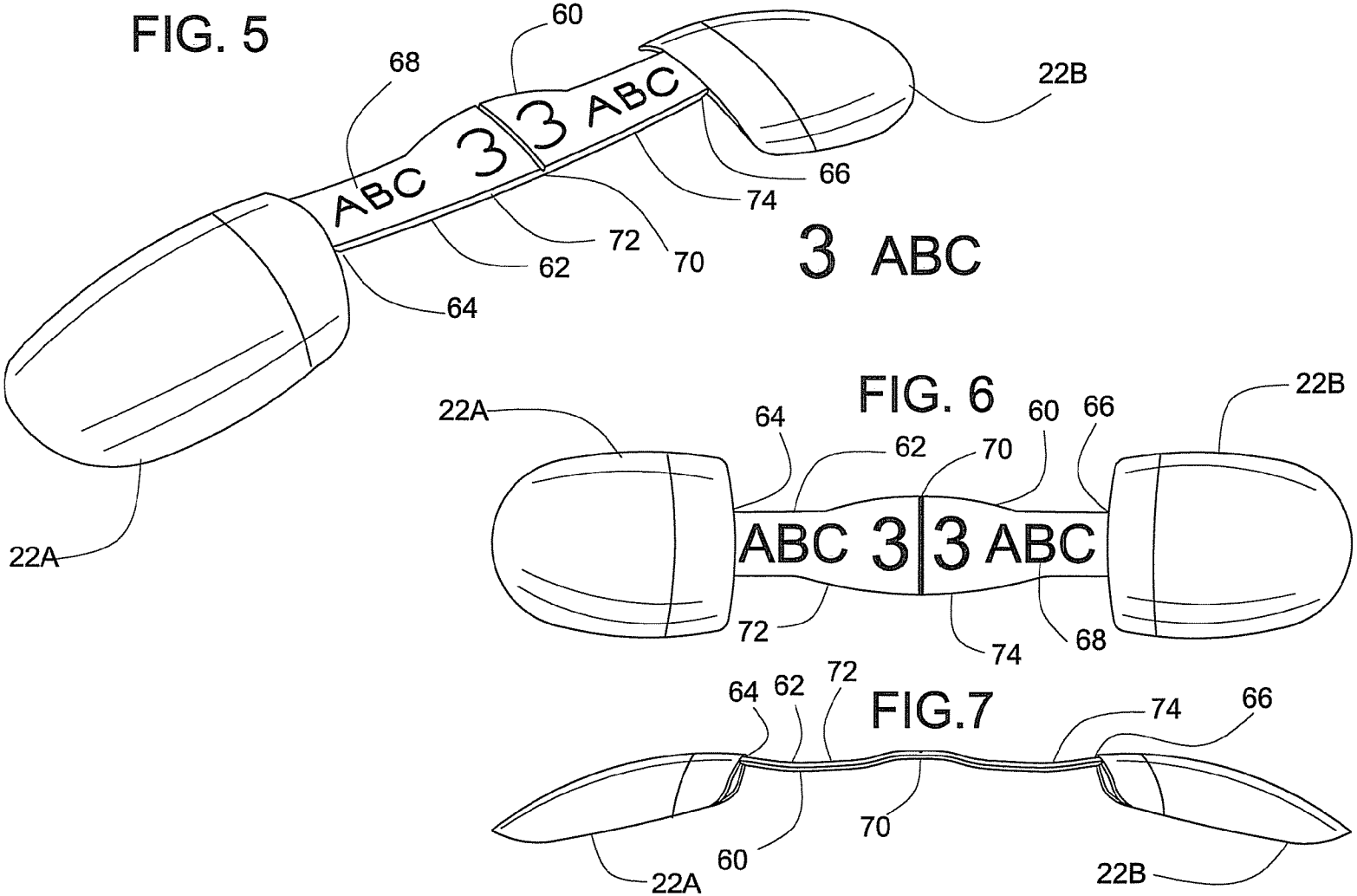
FIG. 5 is a perspective view of an alternate embodiment of an artificial nail assembly constructed in accordance with teachings of the invention.
FIG. 6 is a top plan view of the artificial nail assembly of FIG. 5.
FIG. 7 is a side view of the artificial nail assembly of FIGS. 5 and 6.

An alternate example of an application tab assembly 60 according to teachings of the invention is illustrated in FIGS. 5-7. It will thus be appreciated by those of skill in the art that the tab assembly may be of any suitable design, so long as it couples a pair of artificial nails. The application tab assembly 60 of this embodiment includes a slight widening of the tab assembly 60 in the central area. Similarly, the application tab assembly 80 may be at any appropriate orientation to the nails 82. For example, the tab assembly 80 may be disposed at substantially a right angle to the nails 82, as shown, for example, in FIG. 9 and as discussed in more detailed in application Ser. No. 11/739,371. As similarly shown in FIG. 9, the tab assembly 80 may attach to the nails 82 along a lower surface of the nail, for example.

In order to further assist the user in artificial nail choice, at least the body 62 of the application tab assembly 60 may be sufficiently wide to display information for the user. Thus, the tab assembly 60 may include indicia 68 such as, for example, the size number of the accompanying nail, the name of the manufacturer, a trademark or trade name, the nail color or instructions. The indicia 68 may be provided on the application tab assembly 60 by any appropriate mechanism, such as, for example, molding the indicia into the arrangement, or printing the indicia thereupon. In this way, such indicia 68 may facilitate the user's choice of nail for application.

Figure 8A:
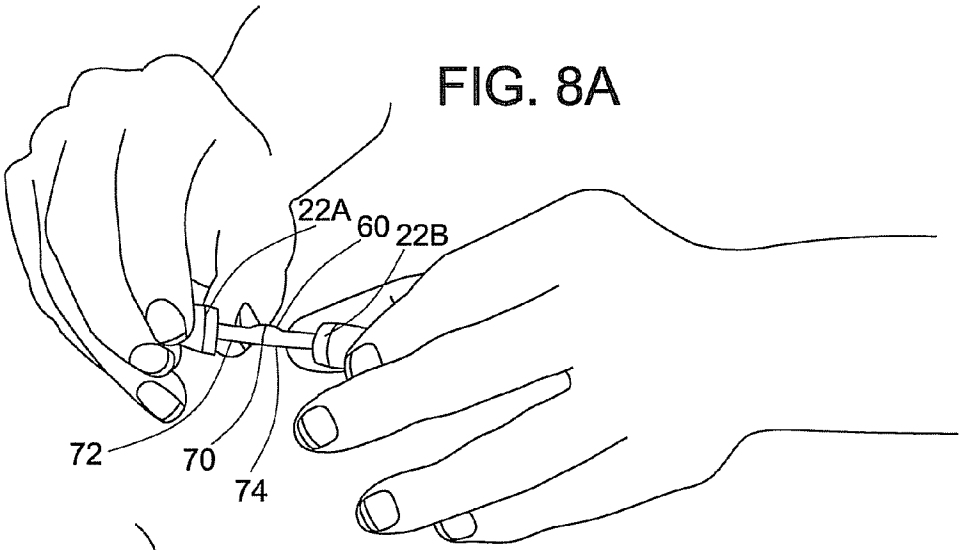
FIGS. 8A and 8B are perspective views of a manner in which the pair of nails may be separated.
Figure 8B:
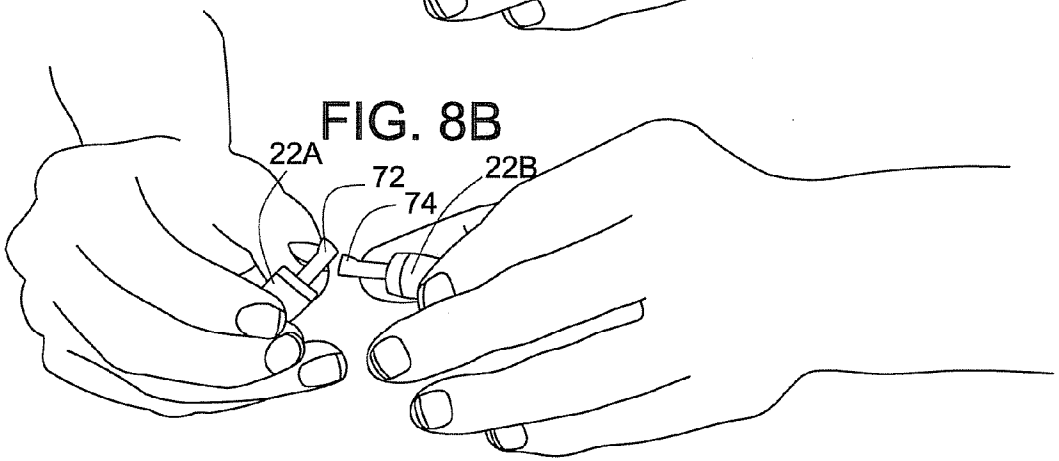

According to another feature of the invention, the application tab assembly 60 may include an area of weakness 70 which facilitates the separation of the application tab assembly 60 into two separate application tabs 72, 74. As with the weakened area 54, 56, 64, 66, the area of weakness 70 may include, for example, a relatively small cross-section 58, such as is as shown, for example in FIGS. 2-4, a thinned section, as shown, for example, at 70 in FIGS. 5-7, a perforation, a score line, or any combination of such structures. As shown in FIGS. 8A and 8B, the user may separate the application tab assembly 60 into a pair of separate application tabs 72, 74, each secured to an artificial nail 22A, 22B. Thus, the user has the option of either applying the nails 22A, 22B from a position attached to the application tab assembly 50, 60 as a single unit, or attached respectively to separated tabs 72, 74.

It will be appreciated that the preformed artificial nails 22 utilized in the nail kit 18 may be of any appropriate design. For example, the invention may likewise be utilized in connection with a nail tip, as opposed to a full nail, as illustrated in the figures. Thus, for the purposes of this disclosure and the claims appended hereto, the term "nail" will be used to correspond to both a full nail and a nail tip. Those of skill in the art will appreciate that the nail tip is essentially the same as a full nail with the exception that the nail tip includes only a portion that is adapted to cover only a distal portion of the natural nail. Moreover, the nail kit may include additional items, such as, by way of example only, an appropriate adhesive, such as is shown in FIG. 1, a rough or emery type surface for buffing the natural nail prior to placement of the artificial nail, a towelette including an acetone or other substance to clean the nail prior to placement, a rosewood stick and/or an application tool for assistance during installation of the artificial nail onto the natural nail surface. Further, the assembly of a pair of artificial with application tab assembly may be fabricated by any appropriate process. By way of example only, the may be injection molded or the like.

While this invention has been described with an emphasis upon preferred embodiments, variations of the preferred embodiments can be used, and it is intended that the invention can be practiced otherwise than as specifically described herein. Accordingly, this invention includes all modifications encompassed within the spirit and scope of the invention as defined by the following claims.

All of the references cited herein, including patents, patent applications, and publications, are hereby incorporated in their entireties by reference.

What is claimed is:

1. A kit of preformed artificial nails, comprising:

(a) a plurality of preformed artificial nail assemblies for placement on a natural nail by a user, each nail assembly of said plurality comprising:

(i) a pair of artificial nails sized to correspond to at least a portion of said natural nail, at least one artificial nail of the pair of artificial nails defining a width in plan view, each said artificial nail having a proximal end adapted to be placed along the natural nail, a lower surface, and a free edge defining a distal edge, and (ii) an application tab assembly extending between each of the free edges of the artificial nails of said pair, the application tab assembly including a body and a pair of necks, a first of said necks disposed adjacent on the lower surface of one of said free edges of said artificial nails extending to the body, the body extending to a second of said necks disposed adjacent on the lower surface of the other free edge of said artificial nails, the body including:

(1) an area of weakness that is an optional place of separation for each assembly to create two separate tabs, one adjacent and secured to the lower surface of each of the artificial nails of the pair, and (2) at least one surface area of sufficient size to include visible indicia; and (b) a package containing said plurality of preformed artificial nail assemblies, each nail assembly of said plurality being coupled to other nail assemblies only by said package, and having a nail placement arrangement of the nail assemblies in detachable pairs.

2. The kit of claim 1 wherein said pair of artificial nails comprises nails of like size.

3. The kit of claim 1 wherein the area of weakness comprises at least one of the following: a line of reduced thickness, a perforation, a score line, a reduced cross-sectional area and a cut.

4. The kit of claim 1 wherein the application tab assembly includes indicia descriptive of said nails attached thereto.

5. The kit of claim 1 wherein the pair of artificial nails and application tab assembly are simultaneously molded together.

6. The kit of claim 1 further comprising at least one of the following: an adhesive, a nail wipe, a manicuring tool, a placement tool, and nail polish.

7. The kit of claim 1 further comprising an area of weakness between the application tab assembly and at least one of the artificial nails, said area of weakness facilitating separation of the application tab assembly from the artificial nail.

8. The kit of claim 7 wherein said area of weakness includes at least one of a perforation, an area of reduced thickness, a score line, a cut, or a reduced cross-sectional area relative to the remainder of the neck.

9. The kit of claim 1 wherein said application tab assembly is disposed at an angle to the nails.

10. The kit of claim 1 wherein said application tab assembly is disposed at substantially a right angle to the nails.

11. The kit of claim 1 wherein said first neck is disposed on the lower surface and the distal edge of one of said free edges of said artificial nails, and said second neck is disposed on the lower surface and the distal edge of the other free edge of said artificial nails.

12. A preformed artificial nail assembly for placement on a natural nail by a user, said artificial nail assembly comprising:

a pair of artificial nails sized to correspond to at least a portion of said natural nail, at least one artificial nail of the pair of artificial nails defining a width in plan view, each said nail having a proximal end adapted to be placed along the natural nail, a lower surface, and a free edge defining a distal edge, and an application tab assembly extending between each of the free edges of artificial nails of said pair, the application tab assembly including a body and a pair of necks, a first of said necks disposed adjacent on the lower surface of one of said free edges of said artificial nails extending to the body, the body extending to a second of said necks disposed adjacent on the lower surface of the other free edge of said artificial nails, the body including an area of weakness that is an optional place of separation for each assembly to create two separate tabs, one adjacent and secured to the lower surface of each of the artificial nails of the pair, and at least one surface area of sufficient size to include visible indicia;

wherein said pair of artificial nails and said application tab assembly are not coupled to any other nail or application tab assembly and wherein said nails are arranged on said nail assembly for placement in detachable pairs.

13. The preformed artificial nail assembly of claim 12 wherein said pair of artificial nails comprises nails of like size.

14. The preformed artificial nail assembly of claim 12 wherein the area of weakness comprises at least one of the following: a line of reduced thickness, a perforation, a score line, a reduced cross-sectional area and a cut.

15. The preformed artificial nail assembly of claim 12 wherein the application tab assembly includes indicia descriptive of said nails attached thereto.

16. The preformed artificial nail assembly of claim 12 wherein the pair of artificial nails and application tab are simultaneously molded together.

17. The preformed artificial nail assembly of claim 12 further comprising an area of weakness between at least one of the artificial nails and the application tab assembly, said weakened area facilitating separation of the application tab from the artificial nail.

18. The preformed artificial nail assembly of claim 17 wherein the area of weakness includes at least one of a perforation, an area of reduced thickness, a score line, a cut, or a reduced cross-sectional area.

19. The preformed artificial nail assembly of claim 12 wherein said application tab assembly is disposed at an angle to the nails.

20. The preformed artificial nail assembly of claim 12 wherein said application tab assembly is disposed in a relatively vertical plane to the nails.

21. The preformed artificial nail assembly of claim 12 wherein said first neck is disposed on the lower surface and the distal edge of one of said free edges of said artificial nails, and said second neck is disposed on the lower surface and the distal edge of the other free edge of said artificial nails.

* * * * *